US006636196B2

(12) United States Patent
Janssen et al.

(10) Patent No.: US 6,636,196 B2
(45) Date of Patent: Oct. 21, 2003

(54) ELECTRO-OPTIC DISPLAY DEVICE USING A MULTI-ROW ADDRESSING SCHEME

(75) Inventors: Peter J. Janssen, Scarborough, NY (US); Lucian R. Albu, New York, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 282 days.

(21) Appl. No.: 09/877,595

(22) Filed: Jun. 8, 2001

(65) Prior Publication Data

US 2002/0186195 A1 Dec. 12, 2002

(51) Int. Cl.[7] ..... G09G 3/36
(52) U.S. Cl. ..... 345/103; 345/99; 345/100
(58) Field of Search ..... 345/100, 103, 345/99, 94

(56) References Cited

U.S. PATENT DOCUMENTS 5,172,105 A * 12/1992 Katakura et al. ..... 345/97
5,742,270 A 4/1998 Kuo ..... 345/100
6,067,061 A * 5/2000 Friedman ..... 345/74.1
6,236,388 B1 * 5/2001 Iida et al. ..... 345/698
6,288,496 B1 * 9/2001 Suzuki et al. ..... 315/169.3
6,320,565 B1 * 11/2001 Albu et al. ..... 345/98
6,507,327 B1 * 1/2003 Atherton et al. ..... 345/68
2001/0046002 A1 * 11/2001 Lin et al. ..... 349/43
2002/0075221 A1 * 6/2002 Waterman ..... 345/99

* cited by examiner

*Primary Examiner*—Richard Hjerpe
*Assistant Examiner*—Mike Fatahiyar

(57) ABSTRACT

A method is provided for utilizing an M by N matrix array of electro-optic display elements that uses multi-row addressing, the method reducing row artifacts owing to adjacent row cross-talk and improving display performance. The method permits the use of a display device with large pixel count, yet with high display definition and performance.

15 Claims, 6 Drawing Sheets

ELECTRO-OPTIC DISPLAY DEVICE USING A MULTI-ROW ADDRESSING SCHEME

FIELD OF THE INVENTION

The present invention relates to the field of electro-optic displays. More specifically, the present invention relates to addressing liquid crystal displays (LCD) using a multi-row addressing scheme.

BACKGROUND OF THE INVENTION

In conventional LCD devices, a matrix of display elements (pixels) may be arranged in a row by column array. To display visual images on the LCD display, a row driver can be used to switch on each element in a particular row. The switched on elements in that row can then receive unique signals from a plurality of column drivers. Each row of the array is switched on or "enabled" sequentially in a row-by-row addressing scheme until all rows have been addressed and the visual image for one frame is displayed.

This conventional system for driving the LCD pixels using a row-by-row addressing scheme has drawbacks in modern uses of LCD devices which demand higher definition. Higher definition can be achieved by increasing the number of pixels within a constant display area. However, simply increasing the number of pixels in a conventional device may degrade the performance of the display.

One reason is that adding pixel elements increases the total capacitive load seen by a column driver. In a conventional LCD matrix array which uses transistors switches, a column driver not only sees the storage capacitor $C_s$ of a target pixel, $C_{pix}$, but also sees the combination of all the $C_s$ within a single column of the array, as well as parasitic capacitances associated with neighboring columns. Switching voltages across such a capacitive load requires that the column drivers have robust current carrying capability. Since the area of a driver device is directly proportional to that current, the conventional row-by-row driving scheme is generally limited to medium resolution displays having a color depth of 24 bits per pixel at a 120 Hz frame rate.

A related reason is that, in a row-by-row scanning sequence, adding pixels decreases the available scanning transfer time, $T_a$, for a row of elements relative to the time needed to scan the entire matrix. Adequate scanning time is needed because the LCD pixels are connected to storage capacitors that require some minimum time to fully charge. As more rows of elements are added, the scanning time may need to be reduced in order to cycle through all the rows in the array in a selected frame time. Adding pixels not only reduces the available scanning time, $T_a$, but compounds the problem by increasing the capacitive load seen by a column. Thus, conventional architecture using a row-by-row addressing scheme may be inadequate for higher performance displays.

In view of current applications requiring higher display definition and higher pixel count, it would be desirable to provide an improved addressing method that can counter-act the negative effects described above and improve display performance.

SUMMARY OF THE INVENTION

A scheme for addressing an M row by N column array of display elements uses "pre-writing" to reduce cross-talk artifact in multi-row addressing. The method may include: delivering a plurality of (Q+1) enabling switching signals to a plurality of (Q+1) rows of elements through electrical connections. Q is a whole number 2 or greater, and the (Q+1)th row is contiguous to the Qth row. The method may further include: delivering independent signals to each enabled element, except those elements in the (Q+1)th row, which row receives a "pre-write" signal, the signals modulating light in the enabled display elements. These above steps may be successively repeated until all rows of elements in the matrix not yet enabled have been addressed. Preferably, the pre-write signals in the (Q+1)th row is the same as the signals in the Qth row. The method can reduce the brightness artifacts in the Qth, 2*Qth, 3*Qth . . . rows. The delivery of signals to each enabled element may be accomplished by row drivers and the delivery of enabling switches may be accomplished by column drivers. The multi-row addressing method with pre-writing facilitates higher performance LCD displays.

BRIEF DESCRIPTION OF THE PRESENTLY PREFERRED EMBODIMENTS

Figure 1:
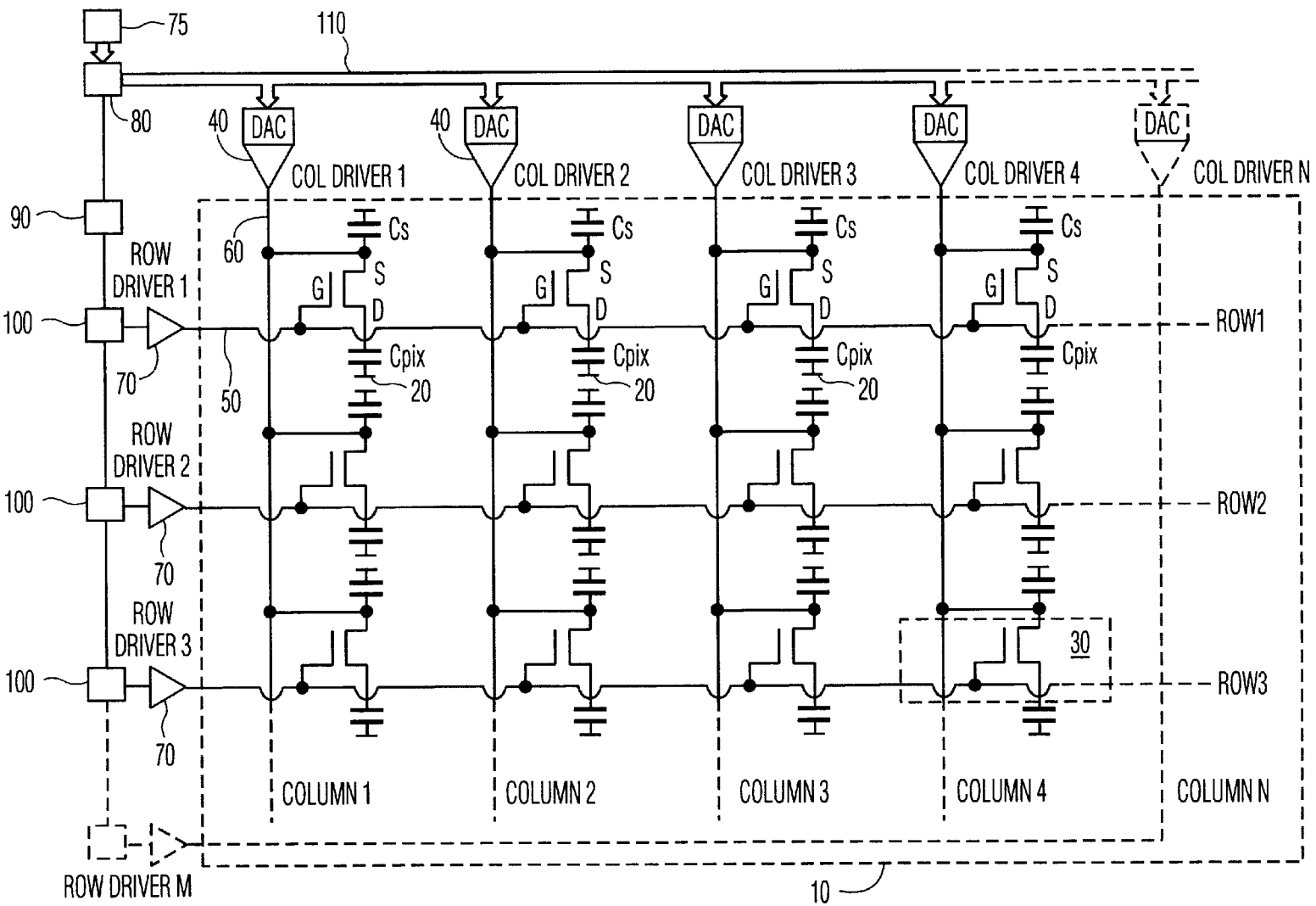
FIG. 1 is a schematic diagram of an active matrix liquid crystal display (AMLCD) device that can use row-by-row addressing.

FIG. 1 depicts a schematic diagram of an, AMLCD device that may be used with conventional, row-by-row addressing. The array panel 10 includes M rows and N columns of display elements 20. Each display element, representing one pixel of the display panel, can connect to a transistor 30 which can act as a switch. The transistor can be an IGFETS type which has a source, s, a drain, D, and a gate, G. The transistor source, s, can be electrically connected to the output of a column driver 40, via electrodes 60 which can be connected to the source of a transistor.

A column driver sees a load represented by a parallel combination of all $C_s$ capacitors in one column of transistors. These $C_s$ capacitances, as well as auxiliary (parasitic) capacitances, (not shown) provide significant capacitive loading which can reduce the speed at which a target pixel capacitor, $C_{pix}$, can be charged.

Row driver 70 can be connected to output electrode 50, which in turn can be connected to gate, G, of every transistor in a particular row. The transistor drain, D, can be connected to $C_{pix}$. The pixel 20, which can be an LCD material, can modulate light as various voltages are applied across $C_{pix}$.

In operation one frame of video information can be generated by a video source 75. This frame of analog video information can be converted to a digital form and stored in digital picture memory 80. To transfer the video frame information in the picture memory to the LCD pixels, the controller circuit 90 can enable the address decoder 100 for row driver 1. This switches on all transistors in row 1 such that each LCD pixel 20 in the row can accept an independent voltage signal from its respective column driver 40. With row 1 enabled, the controller can instruct the picture memory to transfer the video data for the entire row 1 through the data bus 110 which connects to all of the column drivers 40. The digital data can be stored in the column drivers 1 to N and converted into analog data voltages.

The analog voltages can be delivered to each $C_{pix}$, within row 1. Next, the controller 90 can turn off all the transistor switches in row 1 and can turn on the switches in row 2. However, although the transistors in row 1 are switched off, the images already delivered to the pixels in row 1 persist because the voltages are maintained by each respective capacitor, $C_{pix}$, and any auxiliary storage capacitance (not shown). Hence, the row of transistors can be sequentially addressed from row 1 to row M, providing row-by-row scanning for the entire LCD matrix array. Only one row is switched on or enabled at a time. A completed scan of the entire M by N array can thus represent one frame of video information. Subsequent frames of video information can be displayed by the LCD array by re-addressing rows 1 through M.

Figure 2:
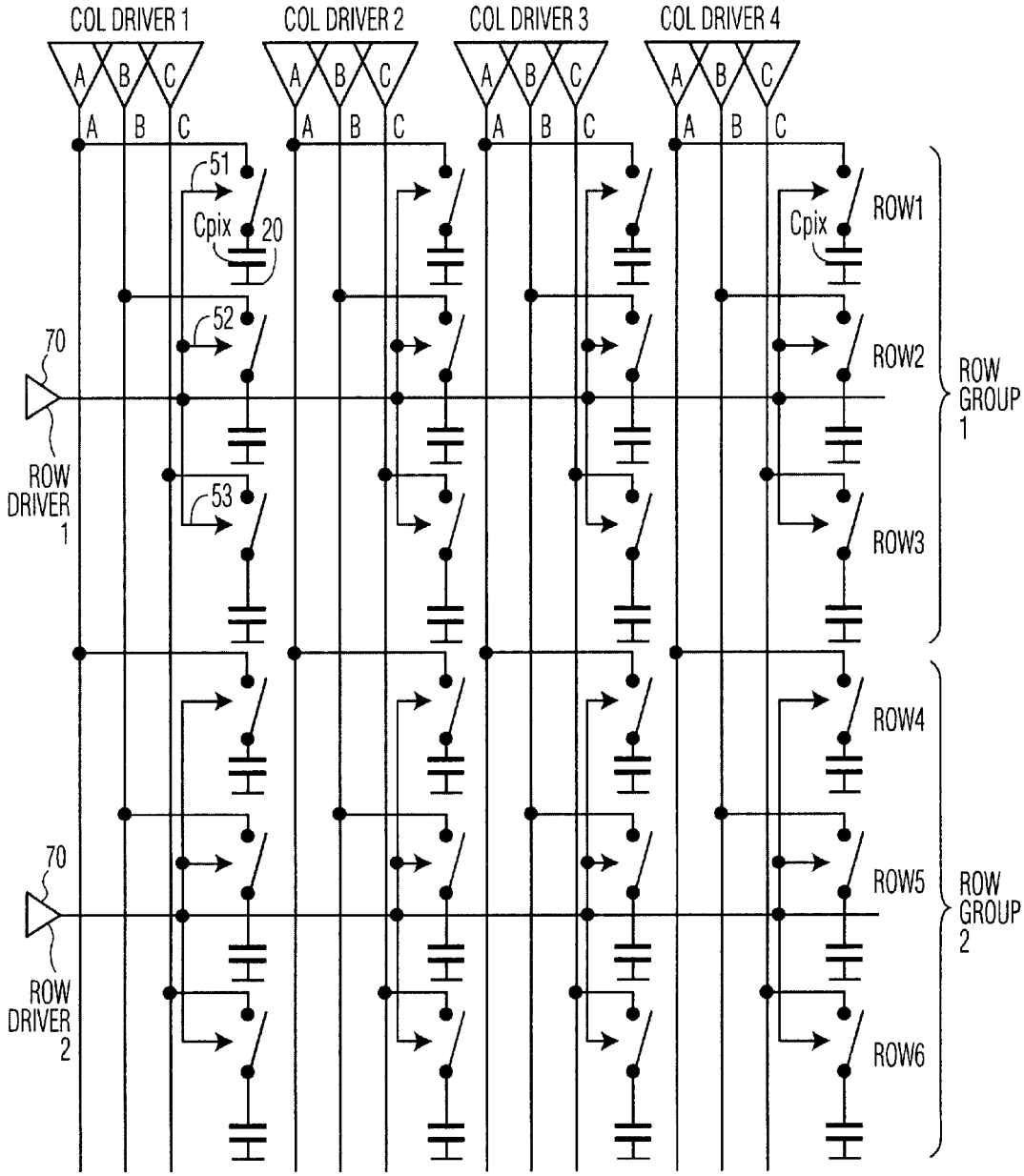
FIG. 2 is a schematic diagram of one embodiment of an AMLCD device that may be used in accordance with the multi-row addressing method of the present invention.

FIG. 2 depicts an exemplary AMLCD device that may be used with the multi-row addressing scheme of the present invention. If Q is the number of rows concurrently addressed in a time $T_a$, then Q in this example is 3. This example shows that Q may also equal the number of column sub-drivers, represented by A, B and C. To address this display device, row driver 1 can provide a concurrent enabling switching signal to the gates of the transistors connected to rows 1, 2 and 3. Every column sub-driver A, B and C can then transfer independent signals to the enabled display elements. Next, row driver 2 can enable rows 4, 5 and 6, while rows 1, 2 and 3 are disabled by row driver 1. Each column sub-driver can then transfer another group of independent signals to the enabled rows. This process may be successively repeated until all the rows in the matrix are addressed.

Figure 3A:
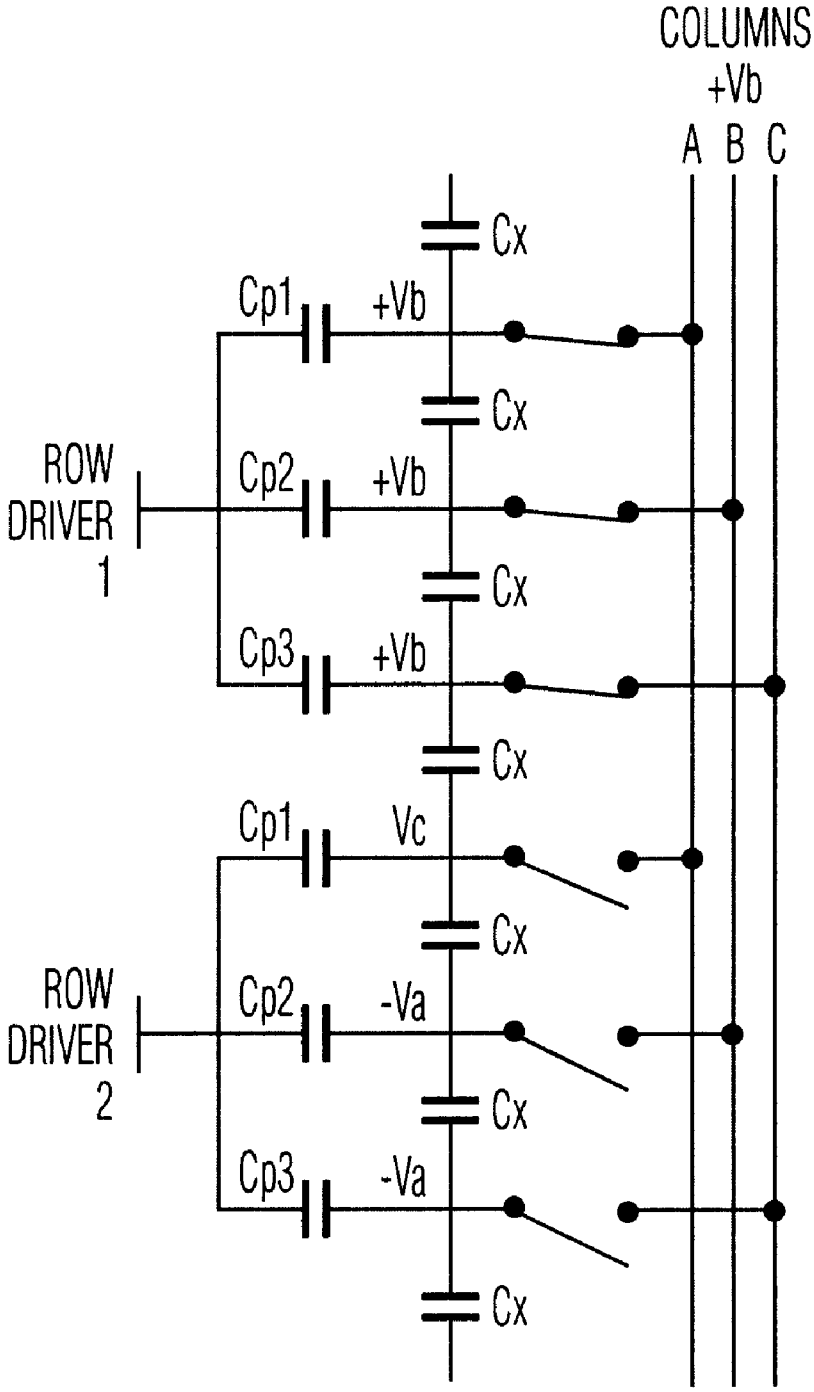
FIG. 3 is a partial schematic diagram of the AMLCD device of FIG. 2, illustrating one embodiment of a multi-row addressing scheme that can produce unwanted row artifacts.
Figure 3B:
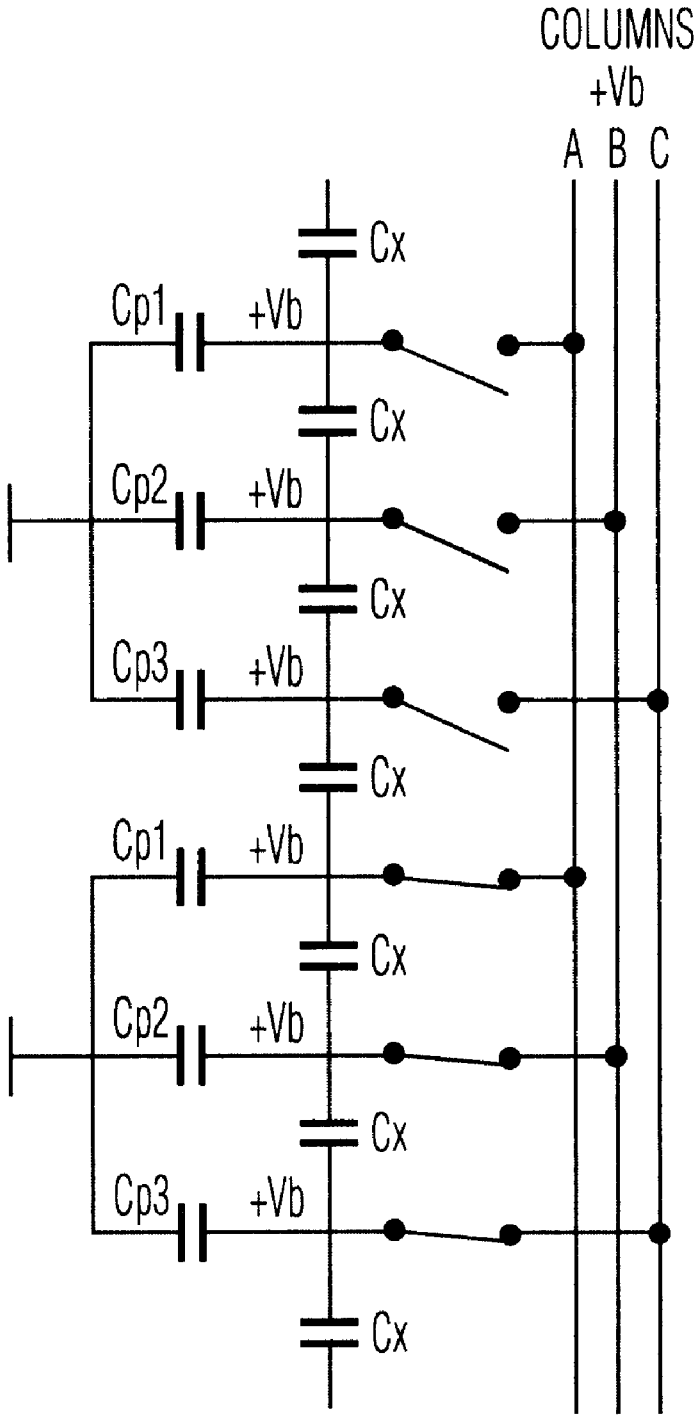

FIG. 3 shows a partial schematic diagram of the AMLCD device of FIG. 2, illustrating one embodiment of a multi-row addressing scheme that can produce unwanted row artifacts. In FIG. 3, Cp1, Cp2 and Cp3 denote pixel storage capacitances. V and Cx denote voltage and cross-row parasitic capacitance. FIG. 3 illustrates how row artifacts may occur using the AMLCD device under a test, "flat-field" condition. "Flat-field" means a condition in which each element in the display has uniform brightness. To achieve this flat-field condition, all voltage input signals from the column drivers should output the same voltage to each display element. That means, in employing a device as shown in FIG. 2, all column sub-drivers provide the same output signal to every display element to achieve a constant brightness throughout the entire display. As shown in FIG. 3, each column sub-driver outputs a constant voltage, +Vb.

Ideally, when each column sub-driver outputs the same voltage for each display element, the display should exhibit uniform brightness. However, in practice, this uniform brightness may not be achieved because of cross-talk effects. FIG. 3 illustrates that, initially, the voltages seen by the storage capacitors $C_{pix}$ can be −Va. FIG. 3(*a*) shows row driver 1, enabling rows (1,2,3) of the matrix array during the first $T_a$. Note that the A, B and C column sub-driver connections can be connected to elements in rows 1, 2 and 3. In the next $T_a$, as shown in FIG. 3(*b*), row driver 2 can enable rows (4,5,6), while rows (1,2,3) are disabled. The effect of cross-talk can be seen in the last row of a group of three, in this case rows 3, 6, 9 etc., which are impressed with pixel capacitor voltage +Vd rather than a desired +Vb. This may be seen as overly bright or dimmed artifact lines in the display.

Figure 4A:
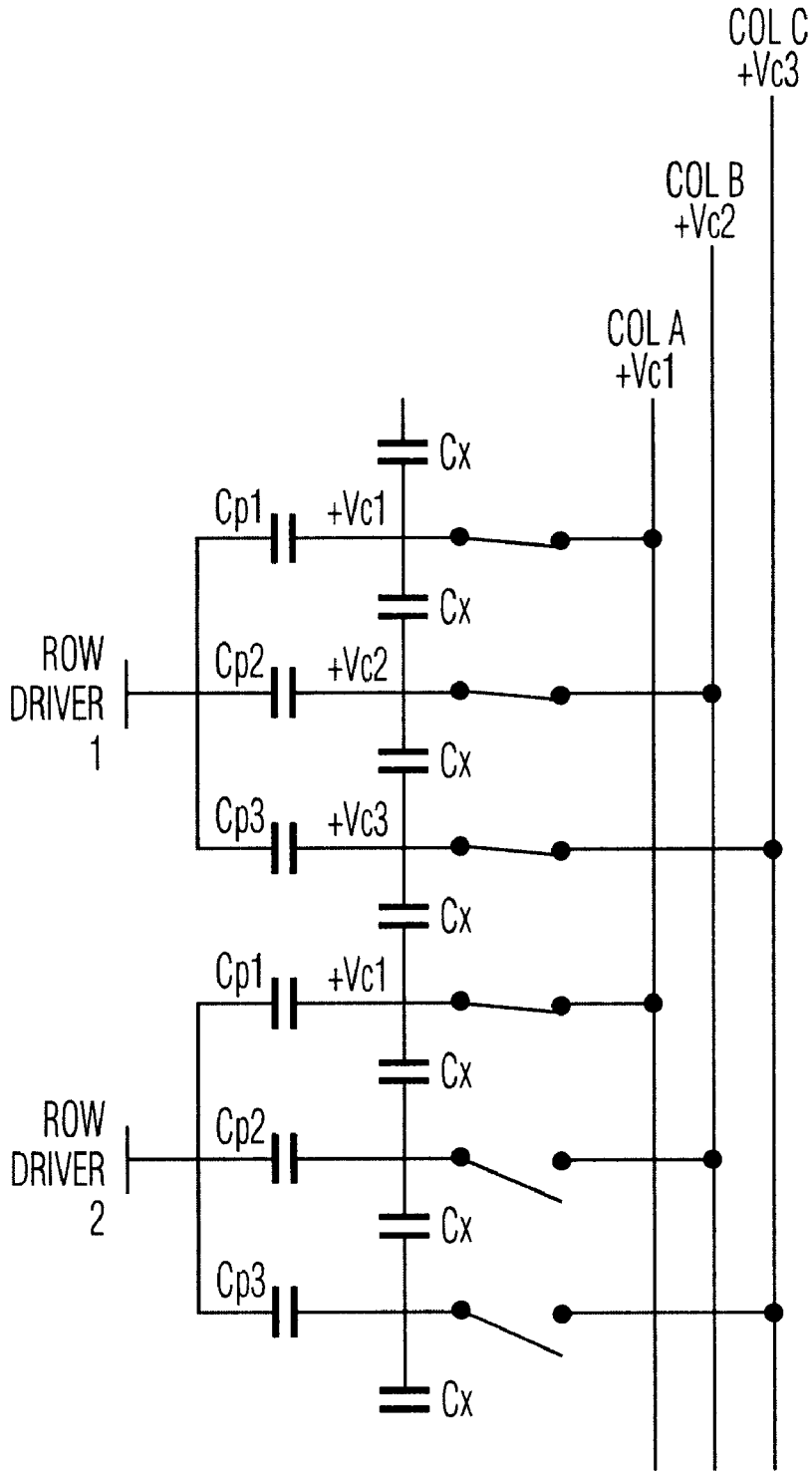
FIG. 4 is a partial schematic diagram of the AMLCD device of FIG. 2, illustrating one embodiment of a multi-row addressing scheme with "pre-writing" which can reduce unwanted row artifacts in accordance with the present invention.
Figure 4B:
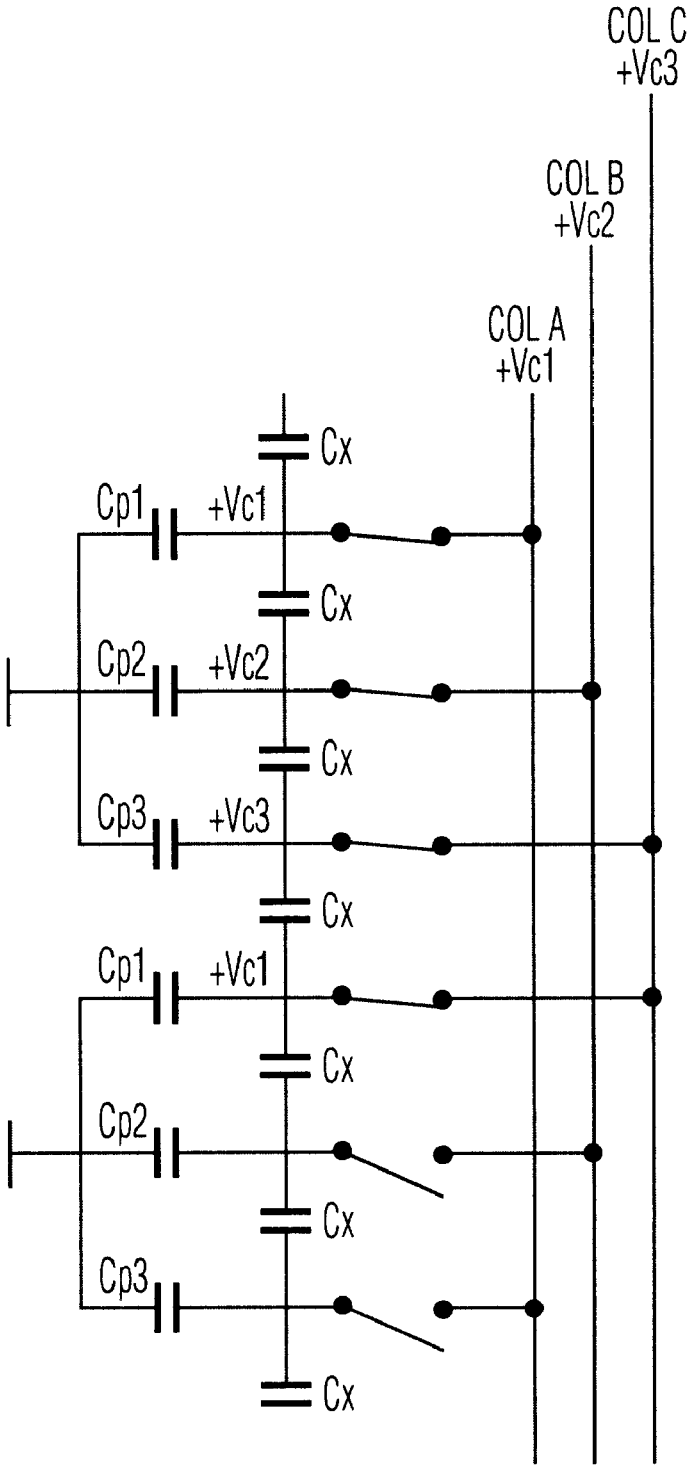

FIG. 4 is a partial schematic diagram of the AMLCD device of FIG. 2, illustrating one embodiment of a multi-row addressing scheme with "pre-writing" which can reduce unwanted row artifacts in accordance with the present invention. The method employs pre-writing the first row of elements in the next group of rows to be addressed in order to reduce cross-talk. FIG. 4(*a*) shows that elements in rows 1, 2, and 3 are enabled by a first row driver. Also, elements of row 4 are enabled to receive pre-write signals that is the same as the signals provided to elements of row 1. FIG. 4(*b*) shows a preferred embodiment of the method where elements of row 4 receive pre-write signals that are the same as the signals provided to elements of row 3.

Implementing the multi-row addressing, pre-writing method in a matrix such as provided in FIG. 2, however, requires some accommodation. It can be seen that row driver 1 may have three connections, 51, 52, and 53. Similarly, row driver 2 has three connections. These three connections may not be easily de-coupled, and thus, row 4 may not be addressable by itself. Thus, when employing the device of FIG. 2, row 4 cannot be enabled by itself, but must be concurrently enabled with rows 5 and 6. Rows 5 and 6 will therefore be superfluously pre-written as well. There may be embodiments of the driving system where each row driver connects to only one row, in which case, rows 5 and 6 will not need to be superfluously pre-written.

It will be appreciated by one skilled in the art that application of this multi-row addressing method with pre-writing is not necessarily limited to the exemplary device depicted in FIGS. 2, 3 and 4. These figures illustrate a specific device embodiment where Q is 3. Simultaneously, Q may also represent the number of column sub-drivers present, as shown in the device of FIG. 2.

Generally, Q can be any whole number 2 or greater. The selection of Q is solely dependent on the available integration technologies and the size of the desired LCD device. The instance of Q equalling 1 merely reduces to conventional row-by-row addressing. The cross-talk artifact is not visible with row-by-row addressing because the effect is applied equally to every row and, therefore, the effect is uniform throughout the display. No corrective pre-writing is needed for row-by-row addressing.

In general for any Q number of concurrent rows addressed during one $T_a$, the (Q+1)th row is pre-written with signals that is the same as one of the previous group of rows. Thus, one step can include delivering a plurality of Q+1 number of enabling switching signals to a plurality of Q+1 number of rows in one scanning time, $T_a$. A second step can include delivering independent signals to all the enabled elements in rows 1 to Q. The (Q+1)th row, however, can receive pre-write signals that are the same signals provided to one row among the rows 1 to Q. Preferably, the (Q+1)th row is pre-written by signals written into the Qth row of elements as shown in FIG. 4(*b*). The above two steps can be successively repeated until all rows of elements in the matrix not yet enabled have been addressed. This pre-writing scheme can substantially reduce the effect of cross-talk in multi-row addressing, thereby enabling higher pixel count and higher display performance.

The invention has been described in terms of exemplary embodiments. The invention, however, is not limited to the embodiments depicted and described and it is contemplated that other embodiments, which may be readily devised by persons of ordinary skilled in the art based on the teachings set forth herein, are within the scope of the invention.

What is claimed is:

1. A method of addressing an array of M row by N column display elements comprising:

(a) delivering a plurality of (Q+1) enabling switching signals to a plurality of (Q+1) rows of elements through electrical connections, wherein Q is a whole number 2 or greater, wherein the (Q+1)th row is contiguous to the Qth row; and (b) delivering independent signals to each enabled element, except those elements in the (Q+1)th row, which row receives a pre-write signal, the signals modulating light in the enabled display elements;

wherein there is a reduction of artifact brightness in the Qth, 2*Qth and 3*Qth ones of the M rows.

2. The method of claim 1, further comprising:

successively repeating steps (a) and (b) until all rows of elements in the matrix not yet enabled have been addressed.

3. The method of claim 1, wherein the step of delivering a plurality of Q+1 enabling switching signals is accomplished by row drivers.

4. The method of claim 1, wherein the step of delivering signals to each enabled element is accomplished by column drivers.

5. The method of claim 1, wherein the display element comprises an LCD connected to a pixel storage capacitor $C_{pix}$.

6. The method of claim 5, wherein the enabling switching signals are connected to transistors via the transistor gate, G, the transistors acting as switches to transfer the enabling signals to the $C_{pix}$ and modulate the LCD element.

7. The method of claim 6, wherein the transistors comprise IGFETS.

8. The method of claim 1, wherein the pre-write signals in the (Q+1)th row are the same as the signals in the Qth row.

9. A device for addressing an array of M row by N column display elements comprising:

means for delivering a plurality of (Q+1) enabling switching signals to a plurality of (Q+1) rows of elements through electrical connections, wherein Q is a whole number 2 or greater, wherein the (Q+1)th row is contiguous to the Qth row; and means for delivering independent signals to each enabled element, except those elements in the (Q+1)th row, which row receives a pre-write signal, the independent signals modulating light in the enabled display elements;

wherein there is a reduction of artifact brightness in the Qth, 2*Qth, and 3*Qth . . . ones of the M rows.

10. The device of claim 9, wherein the means for delivering switching signals comprise row drivers.

11. The device of claim 9, wherein the means for delivering signals to each enabled display element comprise column drivers.

12. The device of claim 9, wherein the display element comprises an LCD connected to a pixel storage capacitor $C_{pix}$.

13. The device of claim 12, wherein the enabling switching signals are connected to transistors via the transistor gate, G, the transistors acting as switches to transfer the enabling signals to the $C_{pix}$ and modulate the LCD element.

14. The device of claim 13, wherein the transistors comprise IGFETS.

15. The device of claim 9, wherein the signals delivered to the (Q+1)th row are the same as the signals delivered to the Qth row.

* * * * *